United States Patent [19]

Jaeger et al.

[11] Patent Number: 4,891,482

[45] Date of Patent: Jan. 2, 1990

[54] DISPOSABLE MICROWAVE HEATING RECEPTACLE AND METHOD OF USING SAME

[75] Inventors: Kirk A. Jaeger, Twinsburg; Yigal Peleg, Solon; David R. Popp, Bay Village, all of Ohio

[73] Assignee: The Stouffer Corporation, Solon, Ohio

[21] Appl. No.: 218,205

[22] Filed: Jul. 13, 1988

[51] Int. Cl.[4] ..... H05B 6/80

[52] U.S. Cl. ..... 219/10.55 E; 219/10.55 F; 426/107; 426/243; 99/DIG. 14

[58] Field of Search ..... 219/10.55 E, 10.55 F, 219/10.55 R, 10.55 M; 426/107, 243, 241, 234, 113, 114; 99/DIG. 14, 451; 126/390

[56] References Cited

U.S. PATENT DOCUMENTS

| | | | |
|---|---|---|---|
| 2,600,566 | 6/1952 | Moffet | 99/221 |
| 2,830,162 | 4/1958 | Copson et al. | 219/10.41 |
| 3,302,632 | 2/1967 | Fichtner | 126/390 |
| 3,591,751 | 7/1971 | Goltsos | 219/10.55 |
| 3,701,872 | 10/1972 | Levinson | 219/10.55 |
| 3,777,099 | 12/1973 | Levinson | 219/10.55 |
| 3,783,220 | 1/1974 | Tanizaki | 219/10.55 |
| 3,854,023 | 12/1974 | Levinson | 219/10.55 |
| 3,865,301 | 2/1975 | Pothier | 229/14 R |
| 3,946,188 | 3/1976 | Derby | 219/10.55 |
| 3,965,323 | 6/1976 | Forker, Jr. et al. | 219/10.55 |
| 3,992,452 | 11/1975 | Forker, Jr. et al. | 428/35 |
| 4,190,757 | 2/1980 | Turpin | 219/10.55 |
| 4,230,924 | 10/1980 | Brastad et al. | 219/10.55 |
| 4,266,108 | 5/1981 | Anderson et al. | 219/10.55 |
| 4,267,420 | 5/1981 | Brastad | 219/10.55 |
| 4,283,427 | 8/1981 | Winters et al. | 426/107 |
| 4,351,997 | 9/1982 | Mattisson et al. | 219/10.55 |
| 4,398,077 | 8/1983 | Freedman et al. | 219/10.55 |
| 4,434,197 | 2/1984 | Petriello et al. | 427/407.1 |
| 4,453,066 | 6/1984 | Mori | 219/10.55 |
| 4,454,403 | 6/1984 | Teich et al. | 219/10.55 |
| 4,518,651 | 5/1985 | Wolfe, Jr. | 428/308.8 |
| 4,520,251 | 5/1985 | Yokozeki | 219/10.55 |
| 4,555,605 | 11/1985 | Brown et al. | 219/10.55 |
| 4,567,341 | 1/1986 | Brown | 219/10.55 |
| 4,590,349 | 5/1986 | Brown et al. | 219/10.55 |
| 4,592,914 | 6/1986 | Kuchenbecker | 426/107 |
| 4,594,492 | 6/1986 | Maroszek | 219/10.55 |
| 4,612,431 | 9/1986 | Brown et al. | 219/10.55 |
| 4,626,641 | 12/1986 | Brown | 219/10.55 |
| 4,641,005 | 2/1987 | Seiferth | 219/10.55 |
| 4,656,325 | 4/1987 | Keefer | 219/10.55 |
| 4,661,671 | 4/1987 | Maroszek | 219/10.55 |
| 4,663,506 | 5/1987 | Bowen et al. | 219/10.55 |
| 4,689,458 | 8/1987 | Levendusky et al. | 219/10.55 |
| 4,701,585 | 10/1987 | Stewart | 219/10.55 |
| 4,703,148 | 10/1987 | Mikulski et al. | 219/10.55 |
| 4,705,929 | 11/1987 | Atkinson | 219/10.55 |
| 4,713,510 | 12/1987 | Quick | 219/10.55 E |
| 4,775,771 | 10/1988 | Pawlowski | 219/10.55 E |
| 4,780,587 | 10/1988 | Brown | 219/10.55 E |

*Primary Examiner*—Teresa J. Walberg
*Assistant Examiner*—Leon Fuller
*Attorney, Agent, or Firm*—Body, Vickers & Daniels

[57] ABSTRACT

There is provided an improved disposable receptacle with a self-supporting configuration for combined baking and cooking of a generally flat food article, such as pizza having a given thickness, in a microwave oven, which receptacle is constructed from a sheet of microwave susceptor stock surrounding the food article and comprising an outwardly exposed, dielectric support layer, such as paperboard, and an inwardly facing heating layer of microwave interactive material allowing passage of microwave energy as it is heated thereby and further including a lower flat portion for supporting the food article during microwave heating. The improvement in this type of disposable receptacle, which is generally a self-supporting sleeve or box, includes forming the lower flat portion of the sleeve with layer means for absorbing nearly all of the microwave energy passing from the outside of the sleeve through the lower portion so that the microwave energy at the lower portion of the sleeve surrounding the food article is converted into heat to a substantially greater extent than other portions of the sleeve. The lower portion of the food product is, thus, heated primarily by conduction, while the upper portion is heated by combined radiation from the susceptor sheet and microwave absorption through the susceptor sheet and from other extraneous heat sources.

40 Claims, 8 Drawing Sheets

FIG. 13 (700 WATT OVEN)

DISPOSABLE MICROWAVE HEATING RECEPTACLE AND METHOD OF USING SAME

DISCLOSURE

This invention relates to the art of microwave heating of food products or articles, and more particularly to a disposable microwave heating receptacle and a method of using this receptacle for reconstituting frozen food products of the mass marketed, consumer type.

INCORPORATION BY REFERENCE

For the purpose of background information, the following United States patents are incorporated by reference herein: Turpin 4,190,757; Brastad 4,267,420; Maroszek 4,594,492; Brown 4,626,641; and, Seiferth 4,641,005. These patents related to concepts for using special sheet stock material for microwave oven cooking of refrigerated and/or frozen food products. These patents constitute a portion of the patented prior art for background of the present invention so that details known in the art need not be repeated to understand the present invention and its novelty and substantial contribution to the field of low cost packaging for microwave reconstitution.

BACKGROUND OF THE INVENTION

The present invention is particularly applicable for reconstituting frozen pizza, such as elongated, rectangular sections of bread topped with pizza constituents and frozen individually. This well known product is to be reconstituted by subsequent thawing and baking by the ultimate consumer. The invention will be described with particular reference to this mass produced, consumer food product; however, it is appreciated that the invention has substantially broader applications and may be used for heating or reconstituting various food products of the type having a lower, generally flat, farinaceous portion which is to be heated to a crisp condition preparatory to serving.

One of the most popular frozen entrees is pizza constructed of a generally rectangular segment of a lower farinaceous crust layer in the form of a French bread and an upper topping layer including a mixture of various substances generally including cheese, tomato sauce and meat. The topping materials are selected to provide a variety of products for the consuming public. In the preferred embodiment, the bread is baked, cut down the middle and quartered into rectangular segments. The topping is added in an uncooked, usually frozen condition. These individual bread segments or sections are sold to the public in a frozen condition for extending their shelf life. Such layered food products or articles, for the best consumer acceptance from a taste and texture sense, should be thawed and then baked by some heating appliance into the desired reconstituted texture and condition. Due to the starch and other characteristics of the lower layer of this food substance, it has been found that high quality reconstitution can be accomplished only by heating in a convection oven. Attempts to reconstitute this type of food or pizza by microwave heating, a concept now popular with and demanded by the public, have not been commercially satisfactory. Consequently, manufacturers who have introduced microwave reconstituted pizza have had to compromise on ultimate quality. A consumer was faced with the dilemma of purchasing a microwavable pizza having a compromised ultimate quality or a high quality pizza of the type reconstituted only in a convection oven. The standard convection oven produced a crunchy, high quality crust having a dough which is crisp and a topping which is cooked to duplicate fresly purchased, hand made pizza.

When attempting to bake, cook or otherwise reconstitute frozen pizza in a microwave oven, cooking time was definitely decreased; however, the pizza lost its bread texture, resulting in almost no crispness or crunchiness. Generally the topping material was overcooked while attempting to make the crust crisp. This process produced a somewhat flaccid product which must be held some time before the pizza is self-sustaining for normal consumption and manual manipulation. Such delay in eating the pizza to decrease its flaccidity, caused the crust to become hard and brittle. Such condition is clearly unacceptable to a manufacturer of mass produced frozen pizza who was concerned about its reputation in the marketplace. Further, the product generally lost its resiliency, turned leathery and caused the hot sauces forming part of the topping to migrate into the prebaked bread cells. This further detracted from consumer acceptance of the reconstituted pizza. The consuming public was provided with the unacceptable dilemma of choosing a low quality product or a high quality product based upon the type of heating desired by the consumer.

To decrease the disparity between microwave reconstituted pizza and convection oven reconstituted pizza, some producers have attempted to prefry a standard pizza crust so the crust would be preset before being frozen. This procedure somewhat reduces the shelf life of the frozen product and has a tendency to increase its fat content. Further, such procedure is known to affect the ultimate flavor of the reconstituted product when using standard pizza crust; therefore, some producers employ added flavors to mask such flavor changes resulting from prefrying the standard pizza crust to increase the crust quality of a microwave reconstituted pizza. Such procedures are not acceptable to companies valuing high reputation or ultimate quality of their reconstituted food entrees.

In view of this situation, one of the most successful pizza products is pizza formed from baked and sliced French bread covered with uncooked ingredients and reconstituted in a convection oven instead of standard crust pizza reconstituted by a microwave oven.

To alleviate the difficulties experienced in microwave reconstitution of pizza, especially using standard crust. special packages have been developed. An early concept is suggested in Turpin 4,190,757 that utilized a lower susceptor sheet spaced from the bottom wall of the microwave oven onto which the lower farinaceous crust portion of the pizza was supported so that the crust portion was heated to a high temperature causing browning and crispness adjacent the lower surface of the crust. This early suggestion has now been employed by certain manufacturers of pizza in the form of a lower plate, boat or platform onto which the pizza on a standard crust is placed for reconstitution in a microwave oven. This procedure, although having some advantages, was not successful until the development of the material now suggested in Turpin 4,190,757; but, disclosed generally in Seiferth 4,641,005. When the microwave susceptor material became available in sheet stock at a low cost such as disclosed generally in Seiferth 4,641,005, such susceptor sheet material was used to construct the previously unsuccessful plates, boats and/or platforms suggested for reconstitution of frozen pizza. By using this new sheet susceptor material, some crispness is obtained at the lower level of the pizza crust; however, the crust remained flaccid and the sauce, forming a constituent of the topping, was overcooked because the topping was exposed to only microwave heating acting upon the many components of the topping. The remainder of the crust layer was heated in a nonuniform manner to result in a soft crust. Frozen pizza reconstituted by a microwave procedure suggested in Turpin 4,190,757 and employing a microwave susceptor sheet of the general type disclosed in Seiferth 4,641,005 is still substantially unacceptable for quality reconstitution of frozen pizza of the type using standard crust. When using a bread base for the pizza, the bread was flaccid. The lower surface of the crust, in both instances, became brown or crisp; however, the rest of the crust was still extremely crunchy. Thus, even use of the new microwave susceptor sheet material had the disadvantages of prior attempts to reconstitute pizza using standard unbaked crust or a bread base in a microwave oven. Even the use of a microwave susceptor sheet, which is well known, as a plate, platform and/or boat on or spaced from the lower wall of the microwave oven, as suggested and attempted by some manufacturers, has been unacceptable. Manufacturers have gone back to the prebaked, standard crust concept for pizza to be cooked by a microwave oven. Some of these manufacturers have packaged the pizza in a vacuum package to increase shelf life which, as mentioned before, is reduced when standard pizza crust is precooked.

In summary, even with the tremendous activity and development work by most frozen food manufacturers and producers of susceptor sheet stock all attempting to microwave reconstituted frozen pizza, there has been no successful heating arrangement on the market that produces an acceptable reconstitution procedure for frozen pizza or similar layered, crust supported food products.

THE INVENTION

The disadvantages and deficiencies of prior attempts to reconstitute a flat frozen food article, such as small sections of pizza of the type using precooked standard crust or a bread base, have been overcome by the present invention so that pizza formed by applying a variety of toppings onto a baked bread substrate can be baked or reconstituted in a microwave oven to produce a reconstituted pizza section that is firm, easily handled, and pleasing in appearance to the consumer while having the texture and taste heretofore obtainable only by heating such food articles in a convection oven.

In accordance with a general aspect of the invention, there is provided a self-supporting box or sleeve formed from a highly metallized microwave susceptor sheet stock so that the sheet stock has a lower flat portion and an upper flat portion to completely surround the flat pizza to be heated in a microwave oven. When in its operative assembled condition, the box or sleeve has generally fixed configurations with a height substantially greater than the thickness of the pizza for which the box or sleeve forms a heating receptacle. This concept uses a susceptor on a generally rigid sheet stock, such as paperboard, which can be bent into a shape that is maintained by the rigidity of the support board. This is different from a wrapping stock wherein the shape is dictated generally by the shape of the product. The invention relates to a receptacle instead of a wrapping.

The base of the self-supporting box or sleeve is made of at least two sheet susceptor layers wherein the additional susceptor layer may be formed integral with the box or sleeve or it may be a separate element. In addition, the surface resistivity of the second susceptor layer can be different from the surface resistivity of the first susceptor layer so that nearly all of the microwave energy passing through the bottom portion of the box or sleeve is absorbed by the two susceptor layers. Consequently, the upper portion of the pizza is surrounded by a microwave susceptor sheet allowing passage of the microwave energy as the susceptor sheet itself is heated by the passage of the microwave rays. Thus, the upper portion of the food article is heated by a combination of radiation from the surrounding susceptor sheet and microwave energy that passes through the susceptor sheet. In the lower portion of the sleeve, the second sheet causes nearly all of the microwave energy to be absorbed and very little stray microwave energy passes through the lower portion of the surrounding sleeve or box to the lower layer of the pizza crust. Thus, relatively high heat energy is created in the lower zone of the box or sleeve surrounding the flat food article, while the remainder of the sleeve or box forms a combination microwave and radiant oven for cooking and baking the topping portion and the upper portion of the bread or crust which is supporting the topping. In this fashion, a substantially higher heat is caused at the lower portion of the sleeve than is caused in the surrounding portion of the sleeve or box. Of course, the second layer of susceptor material could be employed in areas beyond just the bottom portion for changing the heating characteristics of the sleeve or box. When the bread crust extends upwardly along the edges of the pizza base, the second layer of susceptor material may extend upwardly along the side walls of the sleeve.

The lower portion of the sleeve or box is flat and is elevated a preselected distance from the bottom wall of the microwave oven. The heat absorbed in the first layer of microwave susceptor material, formed on paperboard from which the total body of the sleeve or box is cut, is added to and transferred by convection to the second layer of susceptor material. This second layer is further heated by microwave energy and transmits the created heat from the first layer and its own created heat to the bottom surface of the food article resting upon the two layers of susceptor sheet material. This second susceptor layer or sheet material can be glued or laminated to the first layer in the bottom portion of the box or sleeve or it can be an integral part of the paperboard which forms the box or sleeve of the invention.

In accordance with another aspect of the disclosure, an highly heat conductive layer, such as aluminum foil, can be located between the two microwave susceptor layers or sheets. This assists in the heat transfer by conduction of heat from the lower susceptor sheet to the upper susceptor sheet. When this occurs, the upper susceptor sheet is heated by microwave energy coming through the product itself to create a second heat source in the lower portion of the box or sleeve. This heat is not created by microwaves passing through the bottom of the receptacle which is blocked by the foil.

In accordance with another aspect of the invention, the same feature of increasing the heating effect and decreasing the passage of microwave energy through the bottom flat portion of the receptacle, either a box or sleeve, can be accomplished by selectively increasing the amount of metal in the metallized heating layer of the susceptor sheet in the bottom or lower portion of the receptacle. The surface resistivity is, thus, lowered and more heat is created by interaction with the microwave rays reflected from the bottom of the microwave oven. This increased metallization of the heating layer is equivalent to a second layer of susceptor sheet stock material since the increased metallization causes increased heating and a lesser amount of stray microwave energy passing upwardly through the bottom portion of the receptacle into the lower portion of the food article.

In accordance with another aspect of the invention, the receptacle is a sleeve which has side walls that are collapsible so that the sleeve can be flattened and shipped in a position adjacent, i.e. under, the pizza segments. When a pizza segment is to be reconstituted, the flattened sleeve is removed, expanded and used as a self-supporting receptacle for a single pizza segment. This manipulating action, in accordance with another aspect of the invention, extends in a downward direction a set of integral legs cut from the rigid paperboard. These legs or leg means serve to create the necessary spacing between the bottom wall of the microwave oven and the lower flat portion of the receptacle. This provides microwave exposure of the lower flat portion of the receptacle after a pizza segment is wrapped in a plastic bag and sealed with either a vacuum or inert gas in the bag, the segment is frozen and shipped with the sleeve or box collapsed and positioned adjacent the pizza segment. When it is to be reconstituted, the pizza segment is removed from the inner wrapping or bag and placed in the expanded receptacle with the lower crust portion in contact with the lower flat portion of the receptacle or sleeve. The plurality of microwave susceptor sheets are adjacent the crust area of the pizza segment. The height of the sleeve is greater than the thickness of the pizza segment; however, the width of the sleeve is not substantially greater than the width of the segment. In this fashion, there is a space above the pizza, which head space should not be more than one inch and preferably less than about one-half inch.

In accordance with the present invention there is provided a disposable, self-supporting receptacle for combined baking and cooking of a generally flat food article having a given thickness in a microwave oven having a lower wall, the receptacle is constructed from a self-supporting sheet of microwave susceptor stock surrounding the food article and having an outwardly exposed dielectric support layer, such as rigid paperboard, and an inwardly facing heating layer of microwave interactive material allowing passage of the microwave energy as it is heated thereby. This receptacle further includes a lower flat portion for supporting the food article. The improvement, in accordance with the present invention, is providing the lower flat portion of this receptacle with a layer means for absorbing nearly all of the microwave energy passing from the outside of the receptacle through the lower portion whereby the microwave energy at the lower portion of the receptacle is converted into heat to a substantially greater extent than at other portions of the receptacle. Of course, this increased heat could be used at various areas in the self-supporting receptacle by including second layer means for increasing the heating effect at various locations within the free standing receptacle.

In accordance with an aspect of the invention, the additional layer of microwave susceptor material is actually formed integrally with the first sheet stock of rigid, but foldable, paperboard used to form the receptacle. Thus, a single sheet is cut and then formed or folded into the free standing or self-supporting receptacle.

In accordance with another aspect of the invention, the lower power of the receptacle has a reflecting surface to prevent stray microwave energy from passing upwardly through the bottom portion of the receptacle. In practice, this is an aluminum foil which increases the heat conductivity either to the food product or to a second upper layer of microwave susceptor sheet material.

In accordance with another aspect of the present invention, the receptacle is a sleeve formed from the sheet material and the sleeve is provided with means for allowing it to be collapsed into a folded, flat shipping condition and, then, expanded into a free standing sleeve configuration for the microwave heating process. In accordance with an aspect of the invention, the assembly or conversion into the heating configuration causes legs of the sleeve to extend outwardly for the purpose of providing spacing means between the flat lower portion and the wall of the microwave oven. Of course, a separate element such as corrugated board could be used for this spacing purpose.

In accordance with another aspect of the present invention there is provided a method of microwave reconstituting a generally flat frozen, layered food product including a lower farinaceous crust layer and an upper lossy topping layer including a variety of food types, the method comprises the steps of surrounding the food product with a free standing sleeve of microwave susceptor sheet stock with the lower farinaceous layer resting upon a lower flat portion formed from the susceptor stock; providing the lower flat portion of the sleeve with a layer that absorbs nearly all of the microwave energy passing from the outside of the sleeve through the lower portion thereof; placing the sleeve and surrounded food article into a microwave oven in a position spaced upwardly from the lower wall of the oven; and, energizing the microwave oven whereby the lower farinaceous crust layer is heated primarily by high temperature conduction and the upper topping layer is baked and cooked by a combination of radiant and microwave heating.

In accordance with another aspect of the present invention, the method as defined above is performed with a first low energy cycle and a subsequent high energy cycle so that the basic reconstitution of the product occurs during the first heating cycle which may extend for at least about 5.0 minutes at an energy setting of between 25%–50% of the microwave oven energy level. The percentage is primarily a factor of the wattage of the microwave oven with the higher setting being employed for microwave ovens having lower wattage output, such as an oven of the type with about 400–600 watts of output power.

The primary object of the present invention is to provide a disposable, self-supporting heating receptacle which can be employed for microwave reconstitution and/or heating of a food article, such as pizza, which receptacle is low in weight, low cost, and is easily shipped without substantial space required. This receptacle, when used, reconstitutes the food article, by microwave energy, into a food product which has the texture, taste and appearance more closely associated with a product reconstituted in a conventional convection oven.

Another object of the present invention is the provision of a disposable receptacle, as defined above, which receptacle can be produced by generally available paperboard materials by a simple manufacturing operation, such as stamping a blank, folding the blank and gluing portions of the blank together into a sleeve.

Another object of the present invention is the provision of a disposable receptacle, as defined above, which receptacle is not a part of the package used to ship the product; therefore, the shipping package need not be microwavable.

Yet another object of the present invention is the provision of a disposable receptacle for reconstituting and/or cooking pizza of the type formed on a bread base by utilizing sheet material heretofore used in microwave reconstitution of food so that acceptance of the receptacle by the consuming public is of reduced marketing consideration.

Another object of the present invention is the provision of a receptacle which is free standing and self-supporting and formed of microwave absorbing sheet stock with a rigid paperboard so the receptacle shape is determined by the desired heating to be accomplished instead of the shape of the heated product.

These and other objects and advantages will become apparent from the following description taken together with the accompanying drawings described in the next section.

DISCLOSURE

Figure 3:
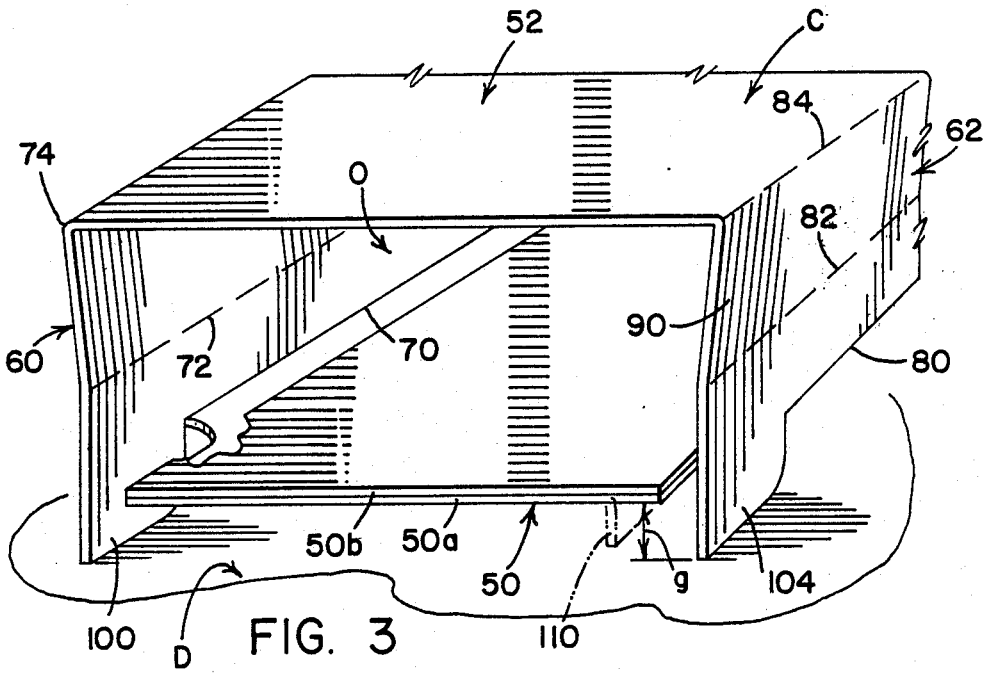
FIG. 3 is a view similar to FIG. 2 showing the preferred embodiment of the present invention in the manually assembled, free standing heating configuration, together with a modification of the invention shown in phantom lines.
Figure 4:
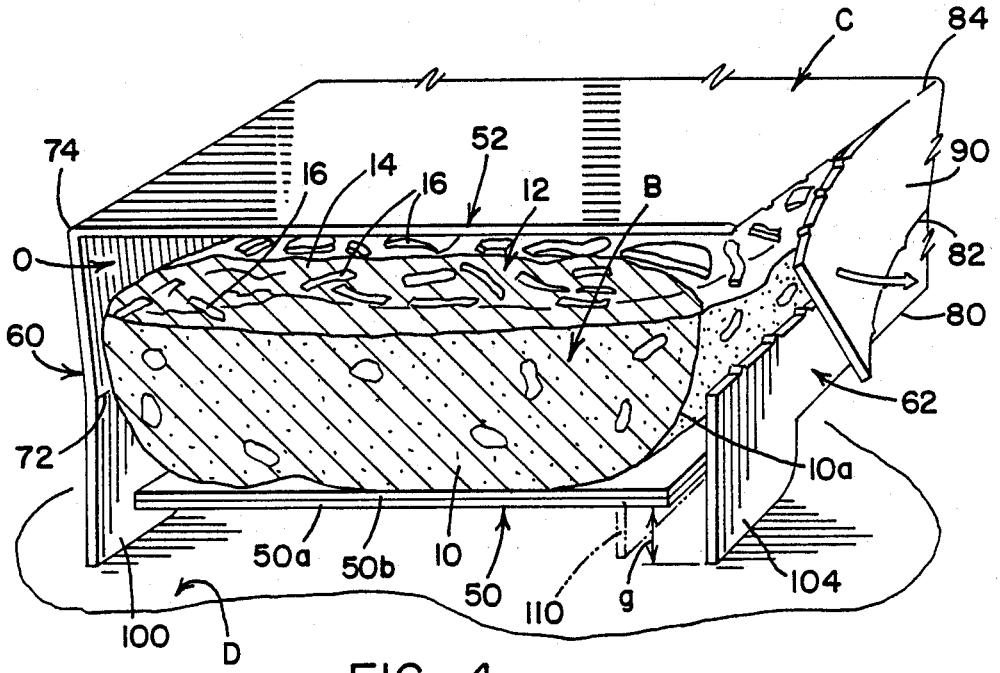
FIG. 4 is a view similar to FIG. 3 with the pizza inserted into a sleeve constructed in accordance with the preferred embodiment of the present invention and illustrating a tear strip feature of the invention, together with the modification of the preferred embodiment again shown in phantom lines.
Figure 5:
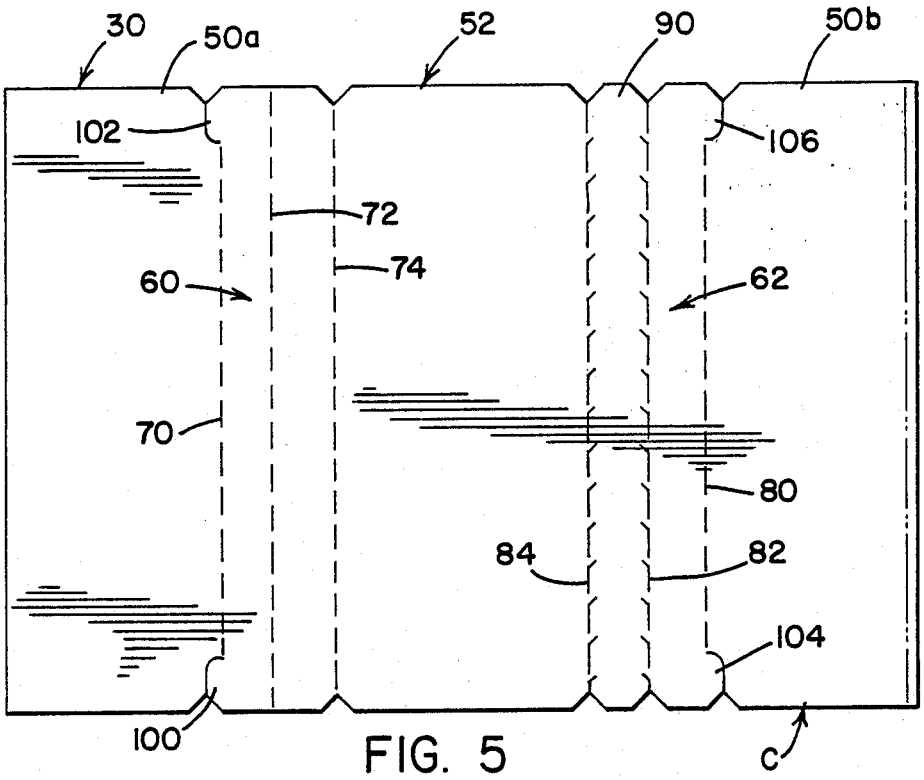
FIG. 5 is a construction layout of the sheet stock blank as it is cut and serrated for assembly into the shape illustrated in FIGS. 1–4.

Referring now to the drawings wherein the showings are for the purpose of illustrating the preferred embodiments of the invention only, and not for the purpose of limiting same, FIGS. 1–4 illustrate a package A for shipping and distributing a frozen entree B such as a flat, elongated rectangular segment of pizza formed by placing on the upper surface of a bread layer 10 having a generally cup-shaped crust 10*a*, a topping layer 12 formed from sauce 14 and miscellaneous food items 16. The bread is baked, sliced and cut to size. Thereafter items 16 in a frozen condition and sauce 14 are spread on the upper surface of the bread. Package A is formed of paperboard and includes an outer shipping carton 20 of the type which is not microwave compatible and is selected for shipment purposes only. Food article B is wrapped in an air impermeable, plastic wrapper 22 which may be evacuated or filled with an inert gas. Article B is frozen and shipped in carton 20 for display in the freezer section of a retail outlet. Within carton 20 there is provided a disposable heating or reconstitution receptacle in the preferred form of sleeve C formed from the sheet paperboard blank, such as illustrated in FIG. 5. Sleeve C is formed from a microwave susceptor sheet stock 30 of the type disclosed in Seiferth 4,641,005. This susceptor sheet includes a generally continuous microwave interactive material 32 formed by vacuum depositing a thin layer of aluminum or similar metal onto a smooth plastic support film 34 which is, in turn, adhered to a flat, generally rigid paperboard 36 forming the support layer for microwave susceptor sheet 30. By changing the surface resistivity of microwave interactive material 32 through changing the thickness of this layer, the amount of heating caused at the layer of interactive material 32 can be modulated. In accordance with the preferred embodiment of the invention, the interactive material is of the type having a surface resistivity of between 13–16 Ohms/inch and is constructed upon a 16 point paperboard which is a somewhat standard weight for the paperboard and is rigid as a standard poster stock. Such microwave susceptor sheet stock material, but with a higher resistivity, is well known in the art and is widely used for microwave heating of various food products. The selection of a low surface resistivity on a firm or generally rigid 16 point paperboard for an encircling free standing sleeve C is believed to be novel. This combination of strength and high heating by low resistivity is a further advantage of the preferred embodiment of the present invention.

Figure 1:
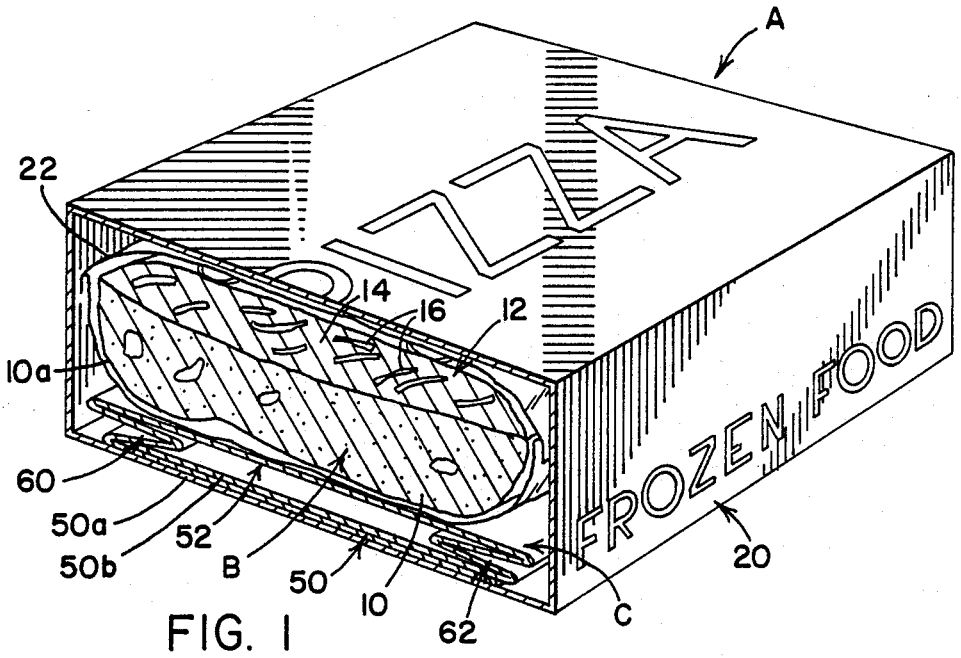
FIG. 1 is a partially cross-sectioned, pictorial view of a packaged pizza segment containing a folded receptacle constructed in accordance with the preferred embodiment of the present invention.

Referring now more particularly to sleeve C, this sleeve includes two parallel, generally flat portions 50, 52 which are adapted to be located on opposite sides of the food item B during the microwave heating operation. In accordance with the present invention, lower or bottom flat portion 50 is formed from two separate layers 50*a*, 50*b* of microwave susceptor sheet stock 30. Consequently, sleeve C comprises parallel flat portions 50, 52 with lower or bottom portion 50 formed by two separate and distinct interactive layers 50*a*, 50*b*. To interconnect parallel, flat portions 50, 52, sleeve C includes integral side walls 60, 62. Wall 60 includes parallel cut lines or serrated seams 70, 72, and 74. In a like manner, wall 62 includes cut lines or serrated seams 80, 82, and 84. By incorporating these seams sleeve C can be folded into a collapsed condition, as shown in FIG. 1, or can be manually expanded into the operative, heating configuration, as shown in FIGS. 3 and 4. To allow easy removal of the heated pizza segment or food item B, after the microwave reconstitution, seams 82, 84 are formed into parallel tear lines so that tear strip 90 can be manually removed from side wall 62. This opening feature allows easy removal of the heated food article and assures that sleeve C is disposed since sleeve C is generally of no use after tear strip 90 has been removed.

Figure 2:
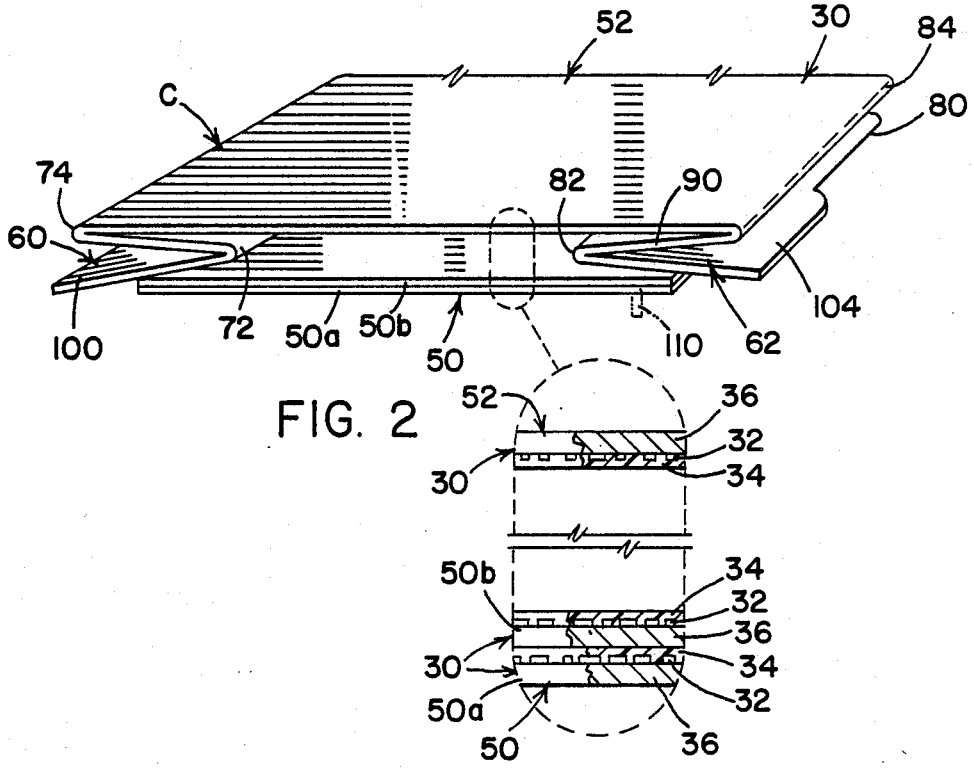
FIG. 2 is a partial, pictorial view of the preferred embodiment of the present invention in the collapsed, shipping configuration, as shown in FIG. 1, and further showing an enlarged partial view illustrating features of the sheet stock of the preferred embodiment of the present invention.
Figure 14:
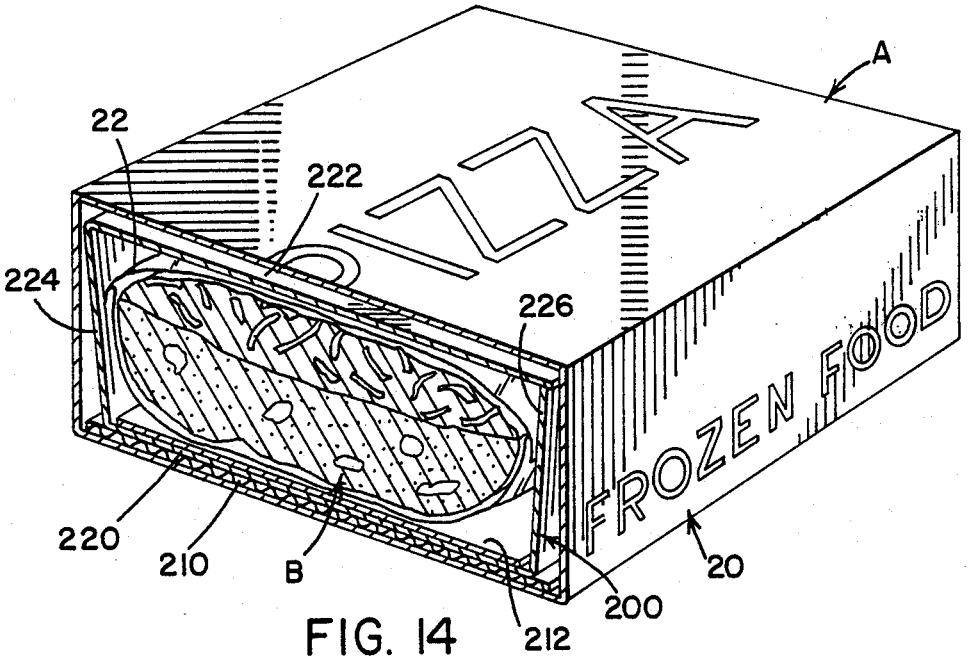
FIG. 14 is a modification of the preferred embodiment wherein the sleeve illustrated in FIGS. 1–4 is an encircling box formed from microwave susceptor sheet stock.
Figure 15:
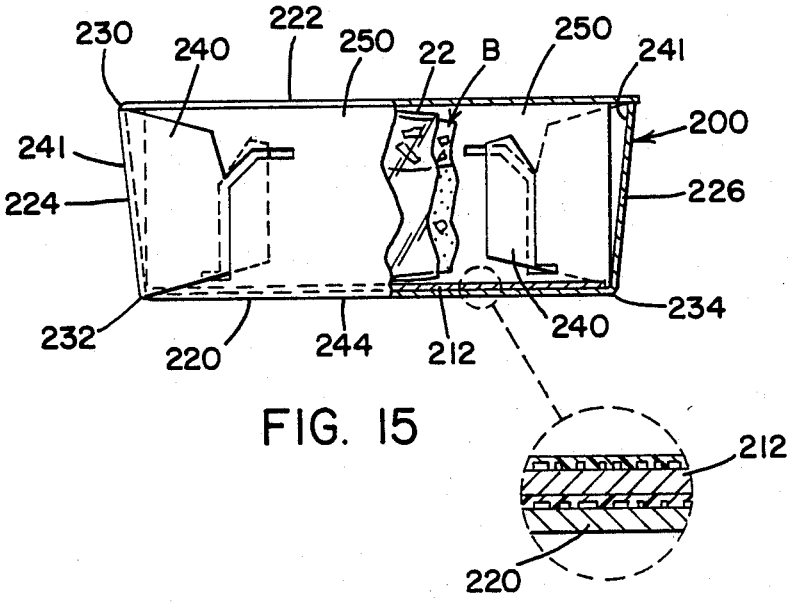
FIG. 15 is a multiple plane cross-sectioned view illustrating various structural features of the modification of the invention shown in FIG. 14, together with an enlarged section illustrating the cross-section of the lower flat wall portion in this modification.

To assure that microwave energy enters through lower portion 50, to heat susceptor layers 50*a*, 50*b*, lower portion 50 must be spaced from the lower wall D of the microwave oven during the heating process. This spacing can be maintained by a separate element as shown in FIG. 14 or, as in accordance with the preferred embodiment, by a plurality of integrally formed downwardly depending legs 100, 102, 104 and 106 which are folded into a generally flat condition when sleeve C is collapsed, as shown in FIGS. 1 and 2, and are moved to downwardly depending positions, as shown in FIGS. 3 and 4, when sleeve C is manually formed into its heating or operative configuration. These legs are cut from the microwaved interactive material 30, as best illustrated in FIG. 5.

Sleeve C is self-supporting and has the features discussed in the introductory portion of this disclosure. It is collapsed or folded and shipped in a generally flat condition in package A, as shown in FIG. 1 and FIG. 2. When article B is to be reconstituted, it is removed from package 22, the sleeve is manually assembled into the configuration shown in FIG. 3 and the pizza or article is slipped longitudinally into the sleeve, as shown in FIG. 4. Side walls 60, 62 extend upwardly along the vertical portion of crust 10*a*. Sleeve C loaded with article B is positioned on lower wall D of the microwave oven and the oven is energized to cook, bake or otherwise reconstitute the frozen food entree or food article B.

Figure 6:
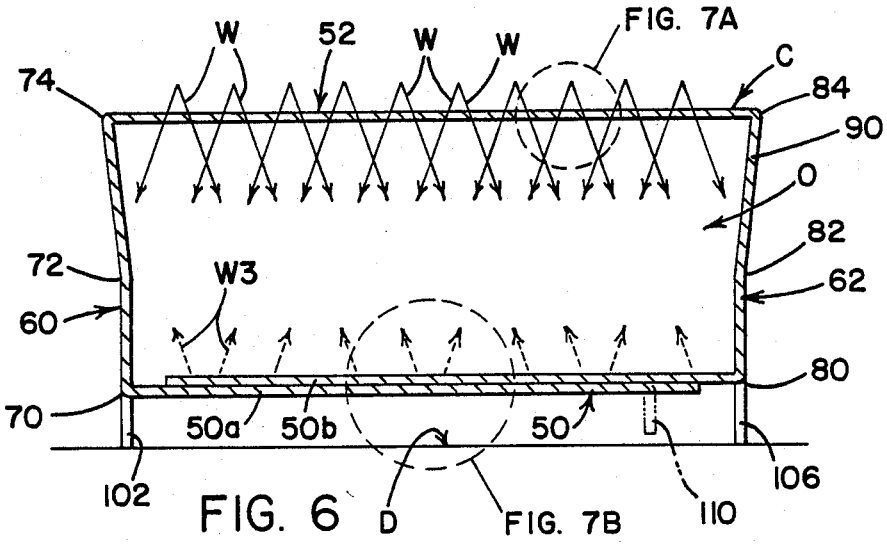
FIG. 6 is a sectional view showing operating characteristics of the preferred embodiment of the present invention with the modification again shown in phantom lines.
Figure 7A:
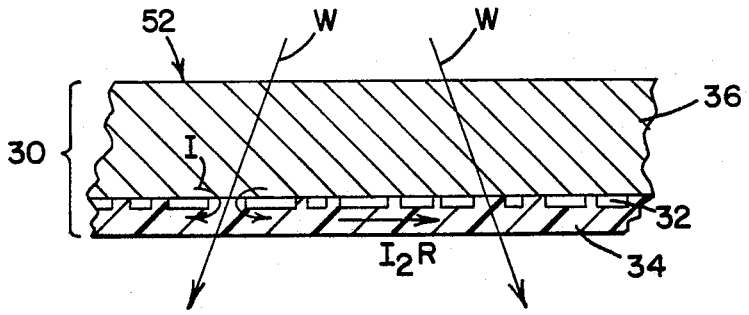
FIG. 7A is an enlarged section illustrating the circular portion 7A of FIG. 6.
Figure 7B:
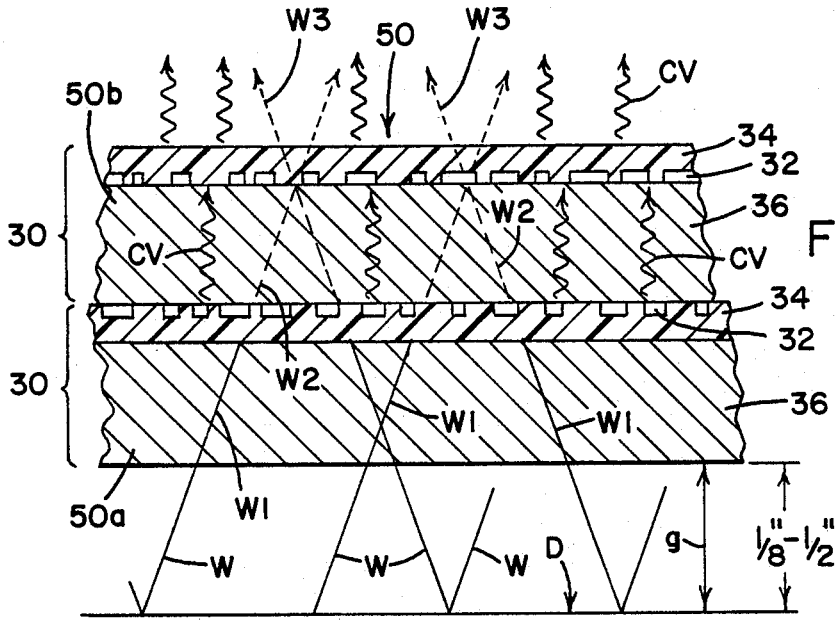
FIG. 7B is an enlarged section illustrating the circular portion 7B of FIG. 6.

Referring now to FIGS. 6, 7A and 7B, the operating characteristics of the preferred embodiment of the present invention, as shown in FIGS. 1–5, are illustrated graphically and in a general manner so that these features can be appreciated even though such appreciation would be well known to persons skilled in the art. Certain specific operating characteristics do form aspects of the present invention. For instance one aspect of the invention is to convert nearly all of the microwave energy passing into sleeve C from the bottom portion 50 into heat for convection into the lower bread layer 10. This is not required to practice the invention but is employed as a general objective or feature of the invention. As shown in FIG. 6, microwave energy, indicated as rays W, penetrate through upper parallel portion 52. During this penetration, rays W give up a certain amount of energy to heat the interactive material layer 32. Thus, the inner chambe O of self-supporting receptacle C is a small oven chamber wherein heat is radiated from that portion of the susceptor sheet 30 forming upper portion 52. A substantial amount of the microwaves, indicated as rays W, pass through material 30 and enter oven chamber O for the purposes of heating the upper portion of pizza segment B by dielectric heating. The microwave heats the topping which is lossy material and portion 52 radiates heat to the topping. Combined radiating and microwave absorption, together with slight convection, causes oven chamber O to heat the topping efficiently, but at a lower temperature level than needed to heat bread 10 and make crust 10*a* crisp. If the microwave susceptor material 30 forming sleeve C had only a single layer at bottom flat portion 50, then the same type of strong microwave heating of bread layer 10 would occur. In accordance with the present invention, lower portion 50 of sleeve C is modified to have two separate layers of microwave susceptor sheet stock 30, as shown in FIG. 7B. As rays W are reflected upwardly toward the vertically elevated, lower flat portion 50, they pass through the two sheets and are reduced in strength as represented by rays W3. To show this feature rays W enter paperboard 36 as rays W1. There is no appreciable energy absorption by the microwave transparent layer 36. The microwave rays then pass through the first interactive layer 32 which removes a substantial amount of energy from rays W1. The amount of absorption is controlled by the amount of metal in layer 32 which is expressed as surface resistivity of interactive layer 32. This energy absorption by layer 32 of layer 50*a* causes a weaker microwave energy ray illustrated schematically as rays W2 that are shown as progressing upwardly through the second layer 50*b* where it interacts with microwave interactive layer 32 of layer 50*b* which converts even more of microwave energy in original ray W into heat. Only a minor portion, if any, of the original microwave radiations, illustrated as rays W, passes through second layer 50*b*. This negligible amount is shown as rays W3, which may be substantially zero. Thus, the lower portion 50*a* is heated by microwavable interactive layer 32. Heat energy is convected from this first layer as indicated by the serpentine lines CV to direct heat upwardly thorugh the second layer 50*b*. This convection heat combines with the further heat generated at the second interactive layer 32 to convert a major portion of the incoming microwave energy into a convection heating as indicated by further lines CV above layer 50*b*. Board 36 of lower layer 50*b* insulates sleeve C so that the convective energy generally moves upwardly through upper portion or layer 50*b* to combine with the heat created in this layer. There is, thus, a high heat concentration at lower crust 10*a*. To enhance this operation, the second layer could be provided in the vertical areas of crust 10*a* adjacent side walls 60, 62. As indicated in FIG. 7A, the heating effect is caused by induced flow of current I when microwaves W pass through an interactive layer 32 of susceptor sheet 30; therefore, penetration by radiation or rays is generally required for the purpose of causing heating of the interactive material. To provide reflected radiation, portion 50 is spaced a distance g from wall D. This spacing is in the range of $\frac{1}{8}$–$\frac{1}{2}$ inch and can be provided by legs 100, 102, 104 and 106, as previously described, or by a spearate spacer element, as the corrugated board shown generally in FIG. 14.

By employing a receptacle constructed in accordance with the invention there is created a unique heating concept. The lower portion of the layered food article is heated by convection, while still using an encircling sleeve which is substantially rigid and convertible between a flattened, folded sleeve to a free standing, self-supporting heating configuration. The sheet material 30 includes a relatively stiff or rigid paperboard that can retain a shape to define a heating oven chamber O. The novel sleeve is a receptacle for heating the article, as opposed to some type of general heat conducting material wrapped around the article and having a shape determined by the article. To add rigidity to this particular construction, the lower layer 50*a* can be provided with a downwardly and transversely extending rib 110, shown in phantom lines in FIGS. 2–4. This rib alows use of a thinner paperboard while maintaining the necessary gap g under lower portion 50. Of course, other downwardly depending tabs and ribs could be provided for further enhancing the rigidity of lower portion 50 to prevent undue sagging of this lower support portion of sleeve C. The self-sustaining, disposable sleeve, including surrounding microwave interactive sheet material 30 with at least two layers coterminous with at least the lower flat portion 50 is novel and produces the advantages discussed in the introductory portion of this disclosure.

Figure 8:
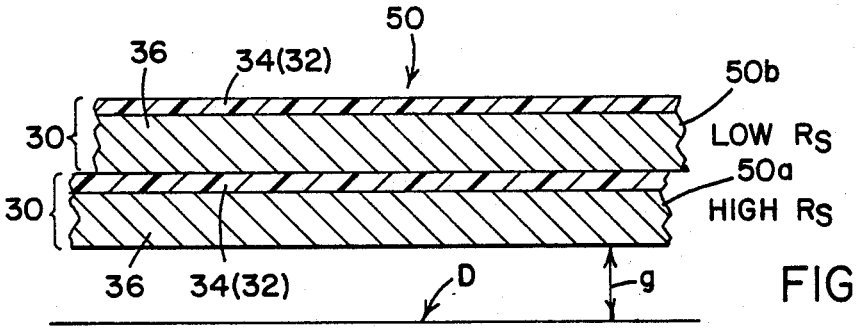
FIG. 8 is an enlarged, cross-sectional view of the lower portion of the receptacle constructed in accordance with the invention and illustrating a slight modification of the preferred embodiment of the invention.

Referring now to FIG. 8, it is illustrated that the surface resistivity of layer 50*a* can be different than the surface resistivity of layer 50*b*. This objective can be accomplished by a separate microwave susceptor sheet forming layer 50*b* or the layer 50*b* can be provided with a different thickness of metal constituting interactive material or layer 32 of sheet 30. The higher surface resistivity of lower layer 50*a* indicates a thinner layer of resistive metal in layer 32 and a correspondingly less heating effect at layer 50*a*. Thus, most heating occurs in layer 50*b* in this particular modification of the present invention. Consequently, conduction from lower layer 50*a* is not as important a component of the total heating effect as when both layers are formed from the same microwave interactive material or sheet 30.

Figure 9:
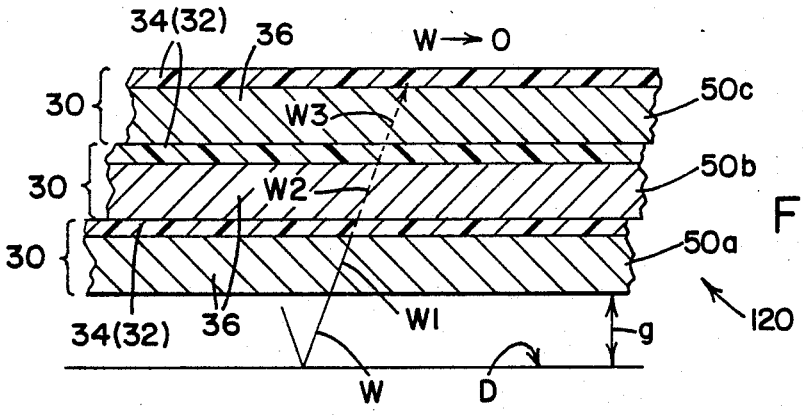
FIGS. 9–12 are enlarged, cross-sectional views taken generally along the lower portion of the receptacle constructed in accordance with the present invention and illustrating modifications which can be accomplished in the lower section in accordance with aspects of the present invention.

Referring now to the modification illustrated in FIG. 9, a third layer 50*c* of microwave interactive material is incorporated in the lower flat bottom portion 120 of a modified sleeve. This separate sheet stock of interactive material can have a separate surface resistivity. As can be seen, the microwave energy is captured at least by the third interactive layer 50*c* so that only a negligible amount of microwave energy enters into layer 10 from lower flat portion 120. In these instances, the paperboard support layers 36 of layers 50*a*, 50*b*, 50*c* can be relatively thin since overall support for the product being heated is obtained by the lower layer 50*a* and at least by lower layer 50*a* in combination with upper layer 50*b*. In accordance with another aspect of the invention, the thickness of the support paperboard or other dielectric material 36 for each layer (50*b*, 50*c*) above the bottom structural support layer 50*a* are relatively thin and may be substantially greater than 16 points.

Figure 10:
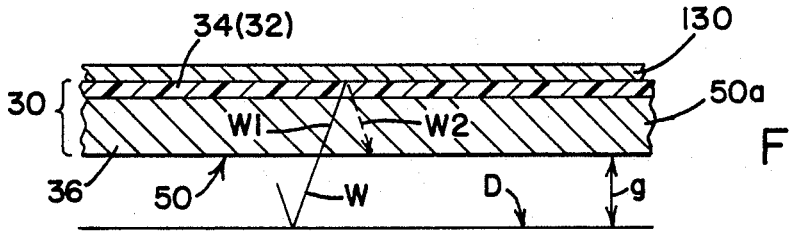
Figure 11:
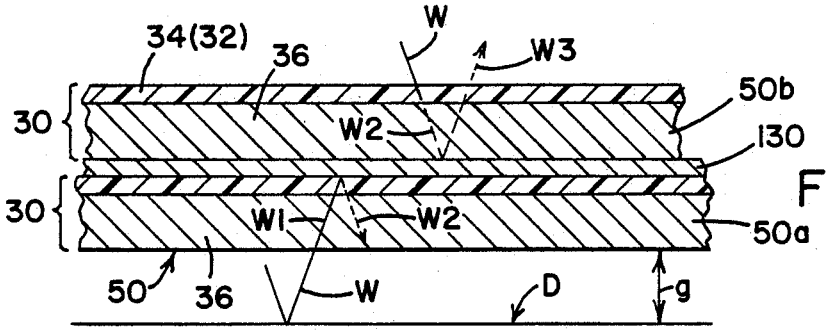
Figure 12:
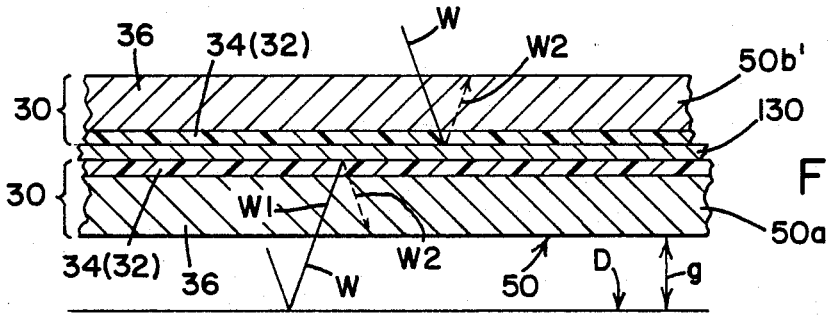

Referring now to FIG. 10, the lower layer 50*a* is covered by a heat conduction layer 130 so that heat generated in lower surface 50*a* is conducted through this heat conductive layer 130 onto layer 10 to cause high heat at crust 10*a*. In the preferred embodiment of this aspect, this conductive layer 130 is aluminum foil that reflects microwave energy. Thus, microwave energy passing through reactive layer 32 of lower layer 50*a* causes $I_2R$ heating as the rays pass toward and away from metal foil, reflective layer 130. This dual action of the rays enhances the heating effect of lower layer 50*a*, which, in turn, causes the temperature surface 130 to be relatively high. Further, the reflective nature of metal layer 130 shields crust 10*a* against microwaves from lower portion 50 of sleeve C. Thus, all heat at the surface of crust 10*a* is by conduction from heated layer 130. A further modification of the concept shown in FIG. 10 is shown in FIG. 11 wherein the heat conduction layer 130 is located between lower layers 50*a*, 50*b*. In this construction, microwave energy which happens to pass downwardly through topping 12 and bread layer 10 is converted into microwave energy by the uppermost layer 50*b* of lower portion 50. A modification of this concept is illustrated in FIG. 12 wherein layer 50*b*′ is similar to layer 50*b* except it is laminated in the reverse position. The interactive material 32 of layer 50*b*′ is adjacent aluminum foil 130. The various configurations illustrated in FIGS. 8–12 are for the purpose of illustrating certain modifications which can be employed in practicing the present invention.

Figure 13:
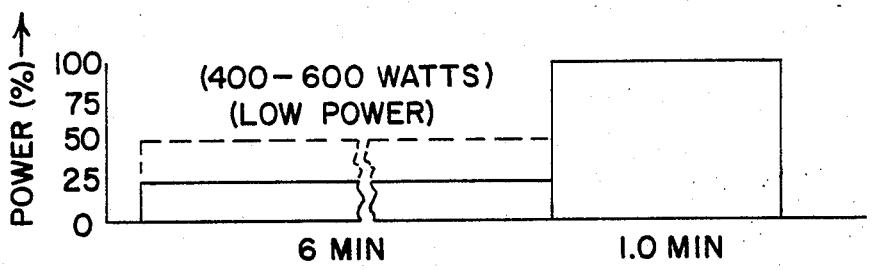
FIG. 13 is a time power graph illustrating the heating cycles employed in the preferred method utilizing the disposable, self-supporting receptacle illustrated in FIGS. 1–12.

In accordance with the cooking method aspect of the invention, the heating cycle for reconstitution of pizza with sleeve C is shown in the example of FIG. 13. In accordance with this example, the microwave oven is energized with a power setting of between 25%–50% for approximately 6.0 minutes. This method has been found to be sufficient to reconstitute pizza segments sold by Stouffer Foods Corporation under the designation "French Bread Pizza". This reconstitution was with a sleeve C. Should the microwave oven have a low power rating, i.e. in the range of 400–600 watts, then the power setting should be at the higher level, such as approximately 50%. A higher power rated microwave oven, such as a microwave oven having a power rating of 600–800 watts, could have the heating cycle reduced to a setting of approximately 25% for about 6.0 minutes. The heating cycle, which causes the starch of the bread layer 10 to swell before water within the starch attempts to heat, is followed by heating for approximately 1.0 minute. This allows the microwave to fully cook the topping portion of the pizza.

Figure 16:
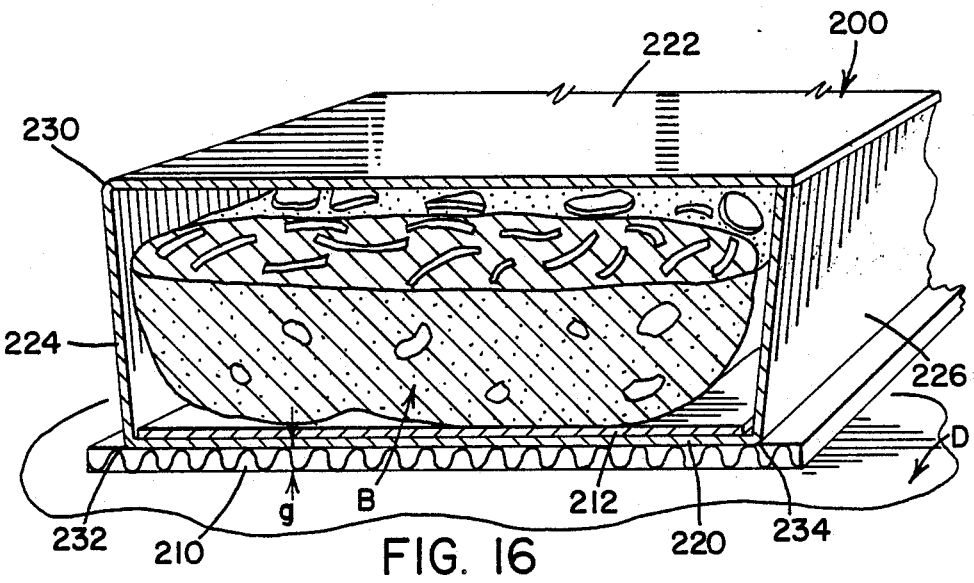
FIG. 16 is a partial pictorial view, in cross-section, illustrating the operating configuration of the modification of the invention shown in FIGS. 14 and 15; and, FIG. 17 is a blank cut from a paperboard support stock and including microwave interactive material which can be employed in the modification of the invention shown in FIGS. 14 and 15 and including certain modifications which are applicable to various disposable receptacles constructed in accordance with the present invention.
Figure 17:
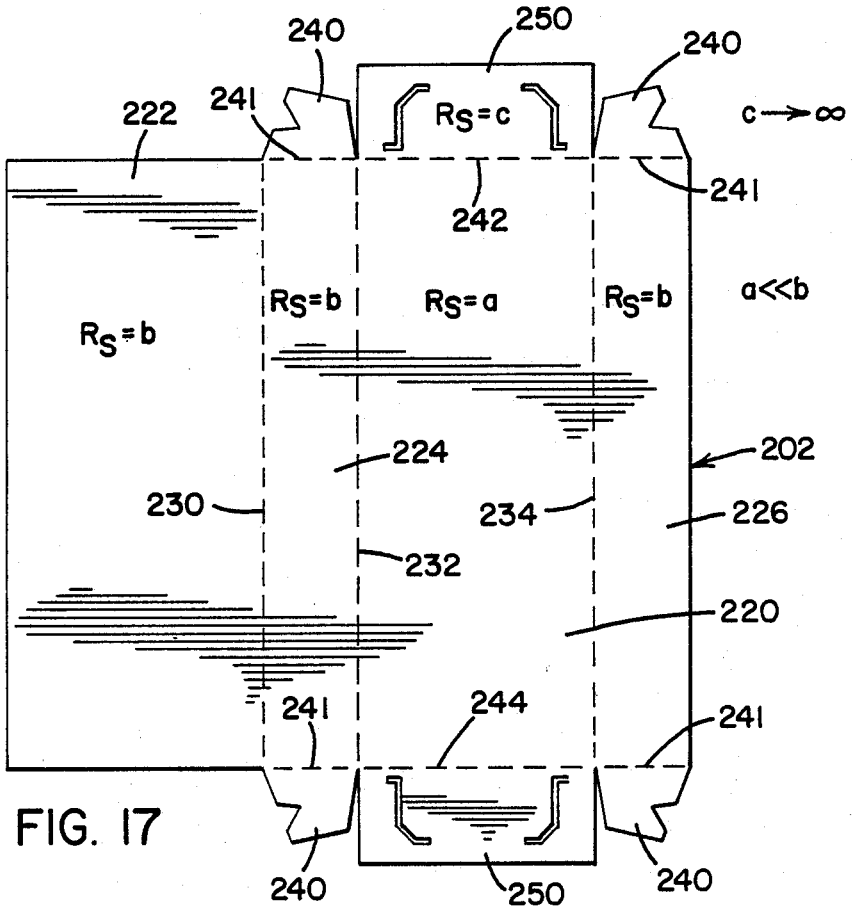

A modification of the preferred embodiment is illustrated in FIGS. 14–17 wherein the free standing receptacle of the present invention is in the structural form of a box 200 assembled from blank 202 of 16 point, generally self-sustaining paperboard and containing, at least, areas of microwave interactive material. Thus, the sheet stock of blank 202 is a microwave susceptor sheet similar to sheet 30 of sleeve C. Blank 202 is illustrated in detail in FIG. 17 and has a shape to be assembled into a structural configuration which will encircle the pizza segment or other food article B shipped in a wrapper 22 in package A, as shown in FIG. 14. In this embodiment, the pizza segment is shown as being actually shipped in heating receptacle box 200 with a first spacing member 210 under the box. Member 210 has a thickness generally corresponding to the desired spacing g. Box 200 includes a separate, second microwave susceptor sheet 212 so that the lower flat portion 220 of the box is provided with two susceptor sheets for the reasons explained in connection with the preferred sleeve configuration. In the box concept, the upper portion of the encircling microwave susceptor sheet is a self-supporting, flat lid 222 joined with lower flat portion 220 by free standing side walls 224, 226 obtained by folding blank 202 along cut lines or seams 230, 232, 234, as best shown in FIG. 17. To facilitate folding of tabs 240 there are provided cut lines or seams 241 so that tabs 240 can be interlocked with end flaps 250 defined by parallel cut lines or seams 242, 244.

Box 200 can be shipped to package A in a flattened condition or assembled around the pizza, as shown in FIG. 14. To assemble the box before or after shipping, end flaps 250 are folded upwardly and interlocked with tabs 240. After sheet insert 212 is placed along bottom portion 220, pizza B is placed within the box. Wrapper 22 is remvoed before actually heating the pizza. As shown in FIG. 16, spacer member 210 is placed under lower flat portion 220 to raise the box a distance g from lower oven wall D for the purposes of heating in accordance with the method described generally in conjunction with the schematic heating cycle shown in FIG. 13.

Blank 202 can be provided with selective areas of different microwave interactive material. To illustrate this concept, the surface resistivity of the various panels in blank 202 are illustrated as having a value a, b, or c. In the illustrated embodiment, the bottom portion 220 has a low surface resistivity which indicates a greater amount of metallization. Consequently, this surface will heat to a greater extent than the side walls and lid which have a higher surface resistivity and, thus, a lower metallization. To convert box 200 into the equivalent of sleeve C, end tabs 240 and end flaps 250 are provided with no microwave interactive metallization. They are merely self-sustaining paperboard. In this manner, microwaves can enter each end of box 200 to function in accordance with the operating characteristics of sleeve C. In a like manner, sleeve C can include various areas of different metallization and various surface resistivity values. In accordance with the invention, a sheet of microwave interactive material encircles the pizza and the lower self-supporting flat portion of the box or sleeve is metallized to produce the desired high temperature at lower crust 10*a*. In accordance with one aspect of the present invention, nearly all of the microwave energy passing upwardly through the lower portion of the box or sleeve is converted to heat energy to create a lower zone of high conduction heat for browning and making the bread supporting the pizza as crisp as a pizza heated in a convection oven.

In accordance with the commercial embodiment of the invention, the microwave susceptor sheet stock material is purchased from James River Corporation of Richmond, Va. and has 16 point board with 13–16 Ohms/in.

Having thus described the invention, the following is claimed:

1. In a disposable receptacle for combined baking and cooking of a generally flat food article, having a given thickness and an outer peripheral shape in a microwave oven having a lower wall, said receptacle being constructed from a first sheet of microwave susceptor surrounding said food article stock having an outwardly exposed, dielectric support layer and an inwardly facing heater layer of microwave interactive material allowing passage of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle and having an outer peripheral shape generally at least as large as said peripheral shape of said food article whereby said receptacle has at least two layers of microwave susceptor sheet stock at said lower portion thereof.

2. The improvement as defined in claim 1 wherein said receptacle is a sleeve having an upper flat portion and side wall means for securing said upper and lower portions in spaced parallel relationship.

3. The improvement as defined in claim 2 wherein said side wall means include first and second walls foldable into a first collapsed, inactive position with said upper and lower flat portions of said receptacle generally folded together and a second, expanded position with said flat portions spaced from each other a distance substantially greater than said given thickness of said food article.

4. In a disposable receptacle for combined baking and cooking of a generally flat food article, having a given thickness in a microwave oven having a lower wall, said receptacle being constructed from a first sheet of microwave susceptor stock having an outwardly exposed, dielectric support layer and an inwardly facing heater layer of microwave interactive material allowing passage of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle whereby said receptacle has at least two layers of microwave susceptor sheet stock at said lower portion; wherein said side wall means include first and second walls foldable into a first collapsed, inactive position with said upper and lower flat portions of said receptacle generally folded together and a second, expanded position with said flat portions spaced from each other a distance substantially greater than said given thickness of said food article; and, wherein said receptacle includes downwardly extending leg means for holding said receptacle in a position spaced vertically from said lower wall of said microwave oven a general distance.

5. The improvement as defined in claim 4 wherein said general distance is in the range of about $\frac{1}{8}$–$\frac{1}{2}$ inches.

6. The improvement as defined in claim 4 wherein said leg means include legs cut from said first sheet susceptor stock.

7. The improvement as defined in claim 4 wherein said leg means include legs movable from a first location generally planar with said first sheet stock when said walls are in said collapsed, inactive position and extending from said lower portion when said walls are in the second expanded position.

8. The improvement as defined in claim 1 wherein said receptacle includes downwardly extending leg means for holding said receptacle in a position spaced vertically from said lower wall of said microwave oven a general distance.

9. The improvement as defined in claim 8 wherein said distance is in the general range of $\frac{1}{8}$–$\frac{1}{2}$ inches.

10. The improvement as defined in claim 8 wherein said leg means include legs cut from said first sheet susceptor stock.

11. The improvement as defined in claim 8 wherein said leg means include legs movable from a first location generally planar with said first sheet stock when said walls are in said collapsed, inactive position and extending from said lower portion when said walls are in the second expanded position.

12. The improvement as defined in claim 1 including means for holding said receptacle in a position spaced vertically from said lower wall of said microwave oven a general distance.

13. The improvement as defined in claim 12 wherein said general distance is in the range of about $\frac{1}{8}$–$\frac{1}{2}$ inches.

14. The improvement as defined in claim 2 including means for holding said receptacle in a position spaced vertically from said lower wall of said microwave oven a general distance.

15. The improvement as defined in claim 14 wherein said general distance is in the range of about $\frac{1}{8}$–$\frac{1}{2}$ inches.

16. The improvement as defined in claim 2 wherein said additional layer of susceptor sheet stock is integral with said first sheet of susceptor stock.

17. The improvement as defined in claim 1 wherein said additional layer of susceptor sheet stock is integral with said first sheet of susceptor stock.

18. In a disposable receptacle for combined baking and cooking of a generally flat food article, having a given thickness in a microwave oven having a lower wall, said receptacle being constructed from a first sheet of microwave susceptor stock having an outwardly exposed, dielectric support layer and an inwardly facing heater layer of microwave interactive material allowing passage of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle whereby said receptacle has at least two layers of microwave susceptor sheet stock at said lower portion thereof; wherein said receptacle is a sleeve having an upper flat portion and side wall means for securing said upper and lower portions in spaced parallel relationship; and, wherein said additional layer of susceptor sheet stock is a second sheet of susceptor stock discontinuous from said first sheet of susceptor stock.

19. The improvement as defined in claim 18 wherein said second sheet of susceptor stock has a surface resistivity different from the surface resistivity of said first sheet of susceptor stock.

20. The improvement as defined in claim 19 wherein the surface resistivity of said second sheet of susceptor stock is substantially less than the surface resistivity of said first sheet of susceptor stock.

21. The improvement as defined in claim 19 including means for adhering said second sheet of susceptor stock onto said first sheet of susceptor stock at said lower flat portion of said receptacle.

22. The improvement as defined in claim 1 wherein said additional layer of susceptor sheet stock is a second sheet.

23. In a disposable receptacle for combined baking and cooking of a generally flat food article, having a given thickness in a microwave oven having a lower wall, said receptacle being constructed from a first sheet of microwave susceptor stock having an outwardly exposed, dielectric support layer and an inwardly facing heater layer of microwave interactive material allowing passage of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle whereby said receptacle has at least two layers of microwave susceptor sheet stock at said lower portion thereof; wherein said additional layer of susceptor sheet stock is a second sheet; and, wherein said second sheet of susceptor stock has a surface resistivity different from the surface resistivity of said first sheet of susceptor stock.

24. The improvement as defined in claim 23 wherein the surface resistivity of said second sheet of susceptor stock is substantially less than the surface resistivity of said first sheet of susceptor stock.

25. The improvement as defined in claim 18 including means for adhering said second sheet of susceptor stock onto said first sheet of susceptor stock at said lower flat portion of said receptacle.

26. The improvement as defined in claim 22 including means for adhering said second sheet of susceptor stock onto said first sheet of susceptor stock at said lower flat portion of said receptacle.

27. The improvement as defined in claim 2 including means, in at least one of said side walls for permanently opening said sleeve.

28. The improvement as defined in claim 2 wherein said layers of microwave susceptor sheet stock of said lower flat portion include microwave absorption layer means for, in combination, absorbing nearly all of the microwave energy passing from outside of said receptacle through said sheet stock layers.

29. The improvement as defined in claim 1 wherein said layers of microwave susceptor sheet stock of said lower flat portion include microwave absorption layer means for, in combination, absorbing nearly all of the microwave energy passing from outside of said receptacle through said sheet stock layers.

30. In a disposable receptacle for combined baking and cooking of a generally flat food article having a given thickness in a microwave oven having a lower wall, said receptacle being constructed from a single sheet of microwave susceptor stock surrounding said food article and having an outwardly exposed, dielectric support layer and an inwardly facing heater layer of microwave interactive material allowing passage of microwave energy as it is heated thereby and said receptacle further including a lower flat portion for supporting said food article, the improvement comprising: said lower flat portion including layer means for absorbing nearly all of the microwave energy passing from the outside of said receptacle through said lower portion whereby said microwave energy at said lower portion is converted into heat to a substantially greater extent than at other portions of said receptacle; and, wherein said layer means is an additional layer of microwave susceptor sheet stock secured on said inwardly facing layer of said lower flat portion.

31. The improvement as defined in claim 30 wherein said additional layer is integral with said sheet stock of said receptacle.

32. The improvement as defined in claim 30 wherein said additional layer of susceptor stock has a surface resistivity different from the surface resistivity of said first sheet of susceptor stock.

33. The improvement as defined in claim 32 wherein the surface resistivity of said second sheet of susceptor stock is substantially less than the surface resistivity of said first sheet of susceptor stock.

34. In a disposable receptacle for combined baking and cooking of a generally flat food article, having a given thickness in a microwave oven having a lower wall, said receptacle being constructed from a first sheet of microwave susceptor stock having an outwardly exposed, dielectric support layer and an inwardly facig heater layer of microwave interactive material allowing passage of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle whereby said receptacle has at least two layers of microwave susceptor sheet stock at said lower portion thereof; said receptacle is a sleeve having an upper flat portion and side wall means for securing said upper and lower portions in spaced parallel relationship, including means for holding said receptacle in a position spaced vertically from said lower wall of said microwave oven a general distance; and, wherein said holding means includes downwawrdly extending portions of said first sheet susceptor stock.

35. In a disposable receptacle for combined baking and cooking of a generally flat food article, having a given thickness in a microwave oven having a lower wall, said receptacle being constructed from a first sheet of microwave susceptor stock having an outwardly exposed, dielectric support layer and an inwardly facing heater layer of microwave interactive material allowing pasasge of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle whereby said receptacle has at least two layers of microwave susceptor sheet stock at said lower portion thereof, and including means for holding said receptacle in a position spaced vertically from said lower wall of said microwave oven a general distance, wherein said holding means includes downwardly extending portions of said first sheet susceptor stock.

36. In a disposable receptacle for combined baking and cooking of a generally flat food article, having a given thickness in a microwave oven having a lower wall, said receptacle being constructed from a first sheet of microwave susceptor stock having an outwardly exposed, dielectric support layer and an inwardly facing heater layer of microwave interactive material allowing passage of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle whereby said receptacle has at least two layers of microwave susceptor sheet stock at said lower portion thereof; and, wherein said receptacle is a sleeve having an upper flat portion and side wall means for securing said upper and lower portions in spaced parallel relationship, including a layer of microwave reflecting metal foil between said layers of microwave susceptor sheet stock.

37. In a disposable receptacle for combined baking and cooking of a generally flat food article, having a given thickness in a microwave oven having a lower wall, said receptacle being constructed from a first sheet of microwave susceptor stock, having an outwardly exposed, dielectric support layer and an inwardly facing heater layer of microwave interactive material allowing passage of microwave energy as it is heated thereby, said receptacle further including a lower flat portion for supporting said food article, the improvement comprising: at least one additional layer of microwave susceptor sheet stock secured onto said inwardly facing layer of said lower flat portion of said receptacle whereby said receptacle has at least two layers of microwave susceptor sheet stock at said lower portion thereof; said receptacle is a sleeve having an upper flat portion and side wall means for securing said upper and lower portions in spaced parallel relationship; and, wherein said two layers are coterminous over most of said lower portion of said receptacle.

38. In a disposable receptacle for combined baking and cooking of a generally flat food article, having a given thickness in a microwave oven having a lower wall, said receptacle being constructed from a single sheet of microwave susceptor stock having an outwardly exposed, dielectric support layer and an inwardly facing heater layer of microwave interactive material allowing passage of microwave energy as it is heated thereby, said receptacle further including a lower flat portion for supporting said food article, the improvement comprising: at least one additional layer of said single sheet of microwave susceptor sheet stock secured onto said inwardly facing layer of said lower flat portion of said receptacle whereby said receptacle has at least two layers of microwave susceptor sheet stock at said lower portion thereof; and, wherein said two layers are coterminous over most of said lower portion of said receptacle.

39. In a disposable receptacle for combined baking and cooking of a generally flat food article having a given thickness in a microwave oven having a lower wall, said receptacle being constructed from a sheet of microwave susceptor stock having an outwardly exposed, dielectric support layer and an inwardly facing heater layer of microwave interactive material allowing passage of microwave energy as it is heated thereby, said receptacle further including a lower flat portion for supporting said food article, the improvement comprising: a layer of microwave reflective sheet stock secured onto said inwardly facing layer of said lower flat portion of said receptacle, and including a second layer of microwave susceptor sheet stock over said reflective sheet stock.

40. A sleeve for heating a food item with an outer peripheral shape, said receptacle comprising a single sheet stock formed into a self-supporting heating chamber and surrounding said food item, said chamber having a flat lower support wall formed from at least two coterminous layers of said single sheet with each layer having a microwave susceptor sheet stock taken together to form an overlapped portion at the support wall of said chamber with said overlapped portion in surface contact with said food item, said overlapped portion having an outer peripheral shape generally at least as large as said peripheral shape of said food item and located only at said flat lower support wall.

* * * * *

UNITED STATES PATENT AND TRADEMARK OFFICE

CERTIFICATE OF CORRECTION

PATENT NO. : 4,891,482

DATED : January 2, 1990

INVENTOR(S) : Kirk A. Jaeger et al.

It is certified that error appears in the above-identified patent and that said Letters Patent is hereby corrected as shown below:

Column 1, line 17, change "related" to ---relate---. Column 2, line 50, after the word "crust", change "." to ---,---. Column 10, line 14, "chambe" should read ---chamber---. Column 13, line 68, after "susceptor", insert ---stock---. Column 14, line 1, delete "stock". Column 17, line 14, "facig" should read ---facing---; line 30, "downwawrdly" should read ---downwardly---.

Signed and Sealed this

Thirtieth Day of July, 1991

*Attest:*

*Attesting Officer*

HARRY F. MANBECK, JR.

*Commissioner of Patents and Trademarks*